US011510538B2

(12) United States Patent
Kashihara

(10) Patent No.: US 11,510,538 B2
(45) Date of Patent: Nov. 29, 2022

(54) VACUUM CLEANER

(71) Applicant: TOSHIBA LIFESTYLE PRODUCTS & SERVICES CORPORATION, Kawasaki (JP)

(72) Inventor: Yutaka Kashihara, Tama (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 56 days.

(21) Appl. No.: 16/958,983

(22) PCT Filed: Feb. 15, 2019

(86) PCT No.: PCT/JP2019/005689
§ 371 (c)(1),
(2) Date: Jun. 29, 2020

(87) PCT Pub. No.: WO2019/160113
PCT Pub. Date: Aug. 22, 2019

(65) Prior Publication Data

US 2020/0329934 A1 Oct. 22, 2020

(30) Foreign Application Priority Data

Feb. 15, 2018 (JP) ..... JP2018-025483

(51) Int. Cl.
*A47L 9/28* (2006.01)
*A47L 5/22* (2006.01)

(52) U.S. Cl.
CPC ..... *A47L 9/2805* (2013.01); *A47L 9/2842* (2013.01); *A47L 9/2884* (2013.01); *A47L 5/22* (2013.01)

(58) Field of Classification Search
CPC .... A47L 9/2085; A47L 9/2842; A47L 9/2868; A47L 9/2884; A47L 5/22
(Continued)

(56) References Cited

U.S. PATENT DOCUMENTS

2015/0366425 A1* 12/2015 Lee ..... A47L 9/2842 15/319
2016/0088992 A1 3/2016 Lee et al.
(Continued)

FOREIGN PATENT DOCUMENTS

CN 1575740 A 2/2005
CN 102334957 A 2/2012
(Continued)

OTHER PUBLICATIONS

International Search Report dated Apr. 16, 2019 in PCT/JP2019/005689 filed Feb. 15, 2019, citing documents AA-AB and AR-AT therein, 1 page.

*Primary Examiner* — Katina N. Henson
(74) *Attorney, Agent, or Firm* — Oblon, McClelland, Maier & Neustadt, L.L.P.

(57) ABSTRACT

In a vacuum cleaner electric blower is driven by power supplied by a secondary battery. A dust-collector is configured to catch and collect dust and dirt sucked by driving the electric blower. A detector is configured to detect a remaining amount of the secondary battery. A controller is configured to control suction force of the electric blower. In the case cleaning is finished when the remaining amount of the secondary battery detected by the detector is equal to or less than a predetermined value, the controller sets the parameter to reduce the suction force of the electric blower for the next cleaning. In the case cleaning is finished when the remaining amount of the secondary battery detected by the detector is not equal to or less than the predetermined value, the controller sets the parameter to increase the suction force of the electric blower for the next cleaning.

18 Claims, 8 Drawing Sheets

(58) Field of Classification Search
USPC ..... 15/319
See application file for complete search history.

(56) References Cited

U.S. PATENT DOCUMENTS

| | | | |
|---|---|---|---|
| 2016/0095488 | A1 | 4/2016 | Lee et al. |
| 2018/0310790 | A1 | 11/2018 | Lee et al. |
| 2019/0208975 | A1 | 7/2019 | Lee et al. |

FOREIGN PATENT DOCUMENTS

| | | | |
|---|---|---|---|
| CN | 102727131 | A | 10/2012 |
| CN | 104053391 | A | 9/2014 |
| CN | 105455726 | A | 4/2016 |
| CN | 108348122 | A | 7/2018 |
| EP | 2 976 978 | A1 | 1/2016 |
| EP | 3 000 373 | A1 | 3/2016 |
| EP | 3 372 138 | A1 | 9/2018 |
| EP | 3 372 138 | B1 | 9/2018 |
| JP | 10-248774 | A | 9/1998 |
| JP | 2001-61739 | A | 3/2001 |
| JP | 3285027 | B2 | 5/2002 |
| JP | 2005-13460 | A | 1/2005 |
| JP | 3736005 | B2 | 1/2006 |
| JP | 2006-180635 | A | 7/2006 |
| JP | 2007-319457 | A | 12/2007 |

* cited by examiner

VACUUM CLEANER

CROSS-REFERENCE TO RELATED APPLICATIONS

The present application is a National Stage Application of PCT/JP2019/005689 filed on Feb. 15, 2019. The PCT application acclaims priority to Japanese Patent Application No. 2018-025483 filed on Feb. 15, 2018. All of the above applications are herein incorporated by reference.

TECHNICAL

Embodiments described herein relate generally to a vacuum cleaner including an electric blower driven by power supplied by a secondary battery.

BACKGROUND

In the prior art, a charging type vacuum cleaner using a rechargeable battery, that is, a secondary battery as a power source incorporates an electric blower configured to suck dust and dirt. The suction force of the electric blower is controlled by, for example, PWM (pulse width modulation) control. In the PWM control, in the case where the ratio of being on-state in the current waveform supplied to the electric blower, that is, duty ratio, is high, the suction force of the electric blower is increased, while in the case where the duty ratio is low, the suction force of the electric blower is reduced. In such a charging type vacuum cleaner, the capacity of the secondary battery is limited. Therefore, in the case where the duty ratio is high and the suction force of the electric blower is increased, the cleaning available time, that is, operable time is shortened.

As a method of changing the duty ratio, for example, a manual operation method performed by a user is used. In an example, a hand operation part includes two switches of strong and weak. When a user operates the switch of strong, the electric blower is controlled with a relatively-large duty ratio for strong operation, while when a user operates the switch of weak, the electric blower is controlled with a relatively-low duty ratio for weak operation.

In an example method of automatically controlling the duty ratio, a sensor is disposed to detect a dust and dirt amount sucked by the driving of the electric blower, in order to ensure cleaning available time, and the duty ratio is set higher as the sensor detects a relatively larger amount of dust and dirt.

In another example method of automatically controlling the duty ratio, the duty ratio is set lower as the number of times of charging of the secondary battery is larger. In the secondary battery, since the storage capacity thereof is lowered as the number of times of charging is larger, the duty ratio is set lower as the number of times of charging is larger, thereby reducing the current flowing in the electric blower, resulting in suppressing the shortening of the cleaning available time.

The necessary cleaning time and suction force depend on the size of a cleaning-object area and the dust and dirt amount therein and further depend on a user, and further it is difficult for a user himself/herself to grasp the necessary cleaning time and suction force. Then, the required art is to automatically optimize the cleaning available time and the suction force for each user.

CITATION LIST

Patent Literature

PTL 1: Japanese Patent Publication No. 3736005
PTL 2: Japanese Patent Publication No. 3285027
PTL 3: Japanese Laid-Open Patent Publication No. 2006-180635

Technical Problem

The present invention is to provide a vacuum cleaner capable of automatically optimizing cleaning available time and suction force.

Solution to Problem

A vacuum cleaner according to the embodiment includes an electric blower, a dust-collecting unit, a remaining amount detector and a controller. The electric blower is driven by power supplied by a secondary battery. The dust-collecting unit is configured to catch and collect dust and dirt sucked by driving of the electric blower. The remaining amount detector is configured to detect a remaining amount of the secondary battery. The controller is configured to control suction force of the electric blower by use of a parameter. In the case where cleaning is finished under the state where the remaining amount of the secondary battery detected by the remaining amount detector is equal to or less than a predetermined value, the controller sets the parameter so as to reduce the suction force of the electric blower for the next cleaning. In the case where cleaning is finished under the state where the remaining amount of the secondary battery detected by the remaining amount detector is not equal to or less than the predetermined value, the controller sets the parameter so as to increase the suction force of the electric blower for the next cleaning.

BRIEF DESCRIPTION OF DRAWINGS

FIGS. 10A1, 10A2, 10A3, 10B1, 10B2 and 10B3

FIG. 10A1 is a graph indicating relation between cleaning time in the first cleaning performed by one user with the above vacuum cleaner and a current output by a secondary battery thereof; FIG. 10A2 is a graph indicating relation between cleaning time in the second cleaning performed by the one user with the above vacuum cleaner and a current output by the secondary battery thereof; FIG. 10A3 is a graph indicating relation between cleaning time in the n-th cleaning performed by the one user with the above vacuum cleaner and a current output by the secondary battery thereof; FIG. 10B1 is a graph indicating relation between cleaning time in the first cleaning performed by another user with the above vacuum cleaner and a current output by the secondary battery thereof; FIG. 10B2 is a graph indicating relation between cleaning time in the second cleaning performed by the another user with the above vacuum cleaner and a current output by the secondary battery thereof; and FIG. 10B3 is a graph indicating relation between cleaning time in the m-th cleaning performed by the another user with the above vacuum cleaner and a current output by the secondary battery thereof.

FIG. 11A is a graph indicating relation between cleaning time in the k-th cleaning performed by one user with the above vacuum cleaner and a current output by a secondary battery thereof; FIG. 11B is a graph indicating relation between cleaning time in the (k+1)-th cleaning performed by the one user with the above vacuum cleaner and a current output by the secondary battery thereof; and FIG. 11C is a graph indicating relation between cleaning time in the (k+2)-th cleaning performed by the one user with the above vacuum cleaner and a current output by the secondary battery thereof.

DETAILED DESCRIPTION

Figure 1:
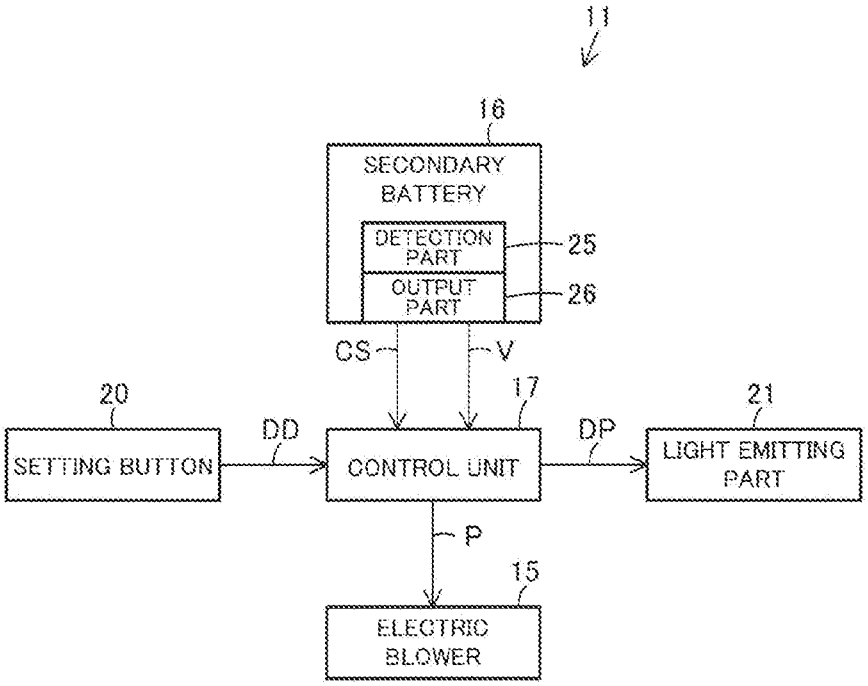
FIG. 1 is a block diagram illustrating an internal configuration of a vacuum cleaner according to the embodiment.

The embodiment is described below in terms of the configuration thereof by referring to the drawings.

Figure 3:
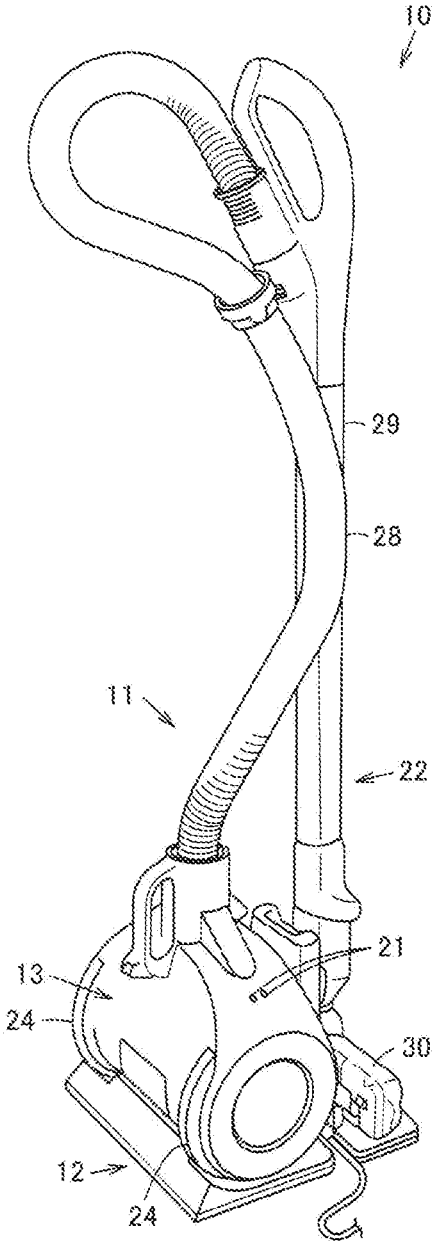
FIG. 3 is an oblique view illustrating a storage state of the above vacuum cleaner.

In FIG. 3, reference sign 10 denotes a vacuum cleaning apparatus. The vacuum cleaning apparatus 10 includes a vacuum cleaner 11, and a storage stand 12 which is a storage apparatus serving as a charging device.

Figure 2:
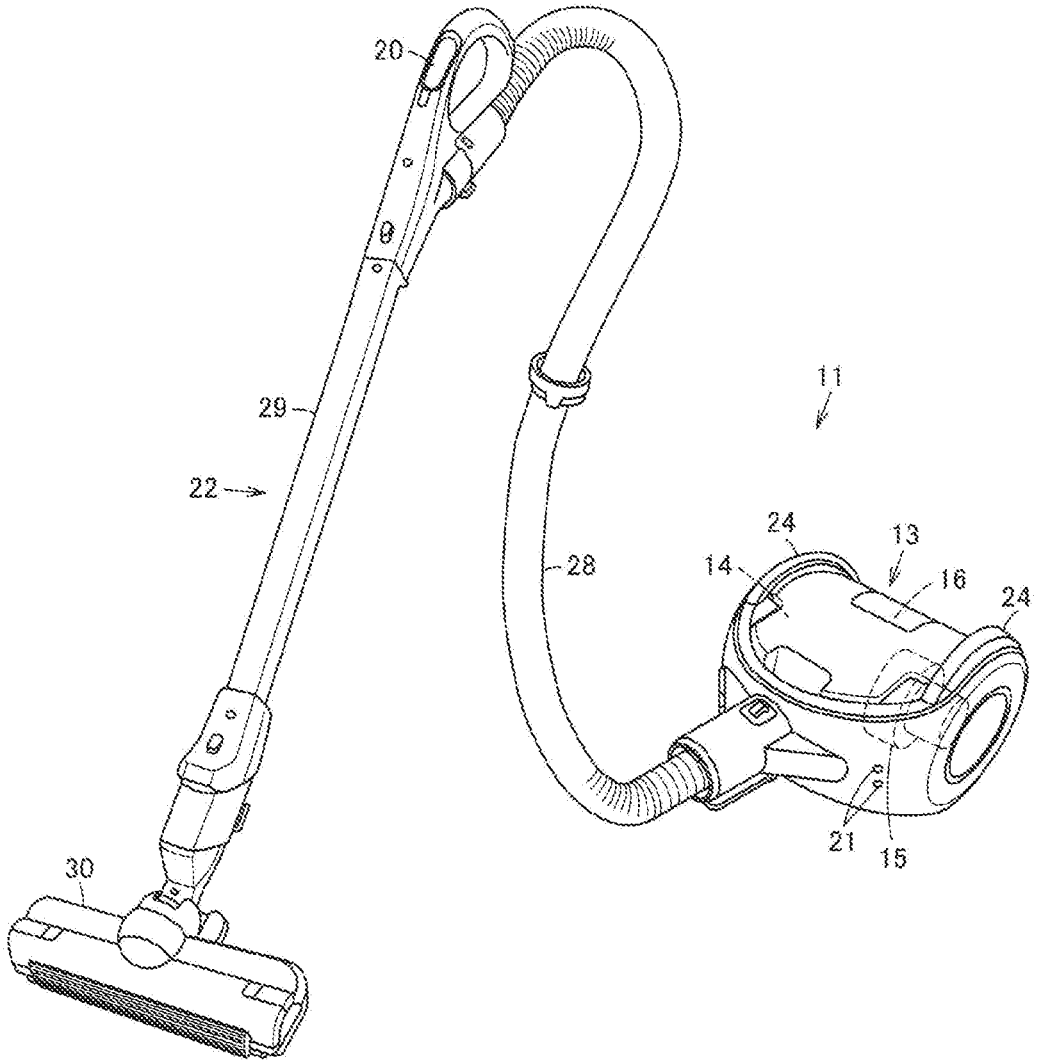
FIG. 2 is an oblique view illustrating a use state of the above vacuum cleaner.

As shown in FIG. 1 and FIG. 2, the vacuum cleaner 11 includes a vacuum cleaner main body 13. The vacuum cleaner 11 further includes a dust-collecting unit 14. The vacuum cleaner 11 further includes an electric blower 15 which is a suction source. The vacuum cleaner 11 further includes a secondary battery 16. The vacuum cleaner 11 further includes a control unit 17 serving as control means. The vacuum cleaner 11 further includes a setting button 20 serving as an operation requesting part. The vacuum cleaner 11 may further include a light emitting part 21 serving as a notification part or an indication part. It is noted that although the vacuum cleaner 11 is a canister type vacuum cleaner including an air path body 22 detachably attached to the vacuum cleaner main body 13 capable of traveling on a floor surface serving as a cleaning-object surface in the present embodiment, the vacuum cleaner 11 may be a handy type vacuum cleaner or a long stick type vacuum cleaner including the air path body 22 detachably attached to the longitudinal vacuum cleaner main body 13. The vacuum cleaner 11 is preferably used also as a self-propelled type vacuum cleaner capable of traveling autonomously. That is, the air path body 22 is not an essential component.

The vacuum cleaner main body 13 incorporates the electric blower 15, the secondary battery 16 and the control unit 17. The vacuum cleaner main body 13 may include, for example, a connection part for charging not shown to be connected to the storage stand 12. The vacuum cleaner main body 13 includes a traveling wheel 24, and is capable of traveling on a floor surface.

The dust-collecting unit 14 is configured to catch and collect the dust and dirt which have been sucked together with air by use of the negative pressure generated by the driving of the electric blower 15, from the air. The dust-collecting unit 14 may be integrally incorporated in the vacuum cleaner main body 13, or may be detachably disposed in the vacuum cleaner main body 13.

The electric blower 15 rotates a fan by an electric motor to generate negative pressure, whereby dust and dirt together with air are sucked into the dust-collecting unit 14.

The secondary battery 16 supplies electric power to, for example, the electric blower 15, the control unit 17, and the light emitting part 21. As the secondary battery 16, for example, a lithium-ion battery or a nickel-hydrogen battery is used. The secondary battery 16 may be a battery pack including a plurality of cells. The secondary battery 16 may include a detection part 25 which is a sensor configured to detect the status of the secondary battery 16. The secondary battery 16 may further include an output part 26 such as a microcomputer configured to output the status detected by the detection part 25. The detection part 25 and the output part 26 may be incorporated in the secondary battery 16, or may be included separately from the secondary battery 16. In the present embodiment, the detection part 25 has, for example, the function of remaining amount detection means configured to detect directly or indirectly a voltage V of the secondary battery 16, that is, a remaining amount of the secondary battery 16. The detection part 25 has the function of charging status detection means configured to directly or indirectly detect whether or not the secondary battery 16 is during charging or not, that is, a charging state CS. The secondary battery 16 is able to be charged by, for example, the power supplied through the storage stand 12. It is noted that, in the present embodiment, a plurality of types of batteries having different capacities are available selectively as the secondary battery 16. Thus, the secondary battery 16 may output the unique information thereof indicting the type of the secondary battery 16 through the output part 26, or may allow mechanical means to grasp the type thereof.

As the control unit 17, for example, a microcomputer is used. The control unit 17 has the function of an operation control part configured to control the operation of the electric blower 15 and the like. That is, the vacuum cleaner 11 includes an operation control part. Specifically, the control unit 17 has the function of controlling the current-carrying amount (current-carrying time) from the secondary battery 16 to the electric blower 15, thereby controlling the operation status such as of at least turning-on/off suction force, and operation power of the electric blower 15. In an example, the control unit 17 has the function of controlling the suction force of the electric blower 15 by, for example, PWM (pulse width modulation) control. That is, the control unit 17 has the function of, through PWM control, controlling the ratio of being on-state in the current waveform supplied to the electric blower 15, that is, a duty ratio, thereby controlling the operation status of the electric blower 15. Specifically, the control unit 17 controls the suction force of the electric blower 15, by setting a value of 0 or larger as a parameter P for controlling the duty ratio of the electric blower 15. In the present embodiment, the larger the parameter P is, the larger the suction force of the electric blower 15 becomes, and the state parameter P=0" corresponds to the state where the operation of the electric blower 15 is stopped. The control unit 17 may have the function of, for example, charging control means configured to control charging of the secondary battery 16. The function of the charging control means may be disposed in, for example, the control unit 17, may be disposed separately from the control unit 17, or may be disposed in the storage stand 12. The control unit 17 may further have the function of notification control means configured to control the operation of the light emitting part 21, thereby enabling to perform notification in a predetermined mode. Specifically, the control unit 17 controls the current-carrying amount or the current-carrying time from the secondary battery 16 to the light emitting part 21, thereby controlling the indication status of the light emitting part 21, specifically in the present embodiment, the notification mode or the indication mode of the light emitting part 21. The function of the notification control means may be disposed in, for example, the control unit 17, or may be disposed separately from the control unit 17.

The setting button 20 allows a user to set the operation such as of the electric blower 15. The setting button 20 is disposed on, for example, the air path body 22 in the present embodiment, or may be disposed on, for example, the vacuum cleaner main body 13.

The light emitting part 21 performs various types of visual notification or indication to a user by use of a light emitting mode such as lighting-on, flickering, or lighting-off. Examples of the information subjected to the notification include the information indicating a charging amount of the secondary battery 16. The light emitting part 21 operates by the power supplied by the secondary battery 16. For example, an LED light serves as the light emitting part 21. The light emitting part 21 is disposed on, specifically in the present embodiment, the front portion of the vacuum cleaner main body 13, or may be disposed at any position, for example, on the air path body 22, as long as the position is easily viewed by a user. It is noted that the light emitting part 21 is not an essential component.

The air path body 22 is configured to apply the negative pressure generated by the driving of the electric blower 15 to a cleaning-object surface such as of a floor surface. That is, the air path body 22 is to be connected to the suction side of the electric blower 15. The air path body 22 allows a user to pull the vacuum cleaner main body 13 of the vacuum cleaner 11 of a canister type and thereby to move the vacuum cleaner 11. In an example, the air path body 22 is detachably attached to the vacuum cleaner main body 13. In the present embodiment, the air path body 22 includes a hose body 28 having flexibility, an extension pipe 29, and a suction port body 30. For example, in the case of a stick type vacuum cleaner, the air path body 22 may be a substantially straight pipe including the extension pipe 29 and the suction port body 30. In the case of an upright type vacuum cleaner, the air path body 22 may include only the suction port body 30.

In the present embodiment, the storage stand 12 shown in FIG. 3 includes the function of the charging base including the function of charging the secondary battery 16 of the vacuum cleaner 11 shown in FIG. 1 by an external power source such as a commercial AC power source. In the present embodiment, the storage stand 12 is capable of storing the vacuum cleaner 11 in a charging state. It is noted that, instead of the storage stand 12, a simple charging device is available, including the function of allowing the secondary battery 16 of the vacuum cleaner 11 to be charged in a connected state, without the function of storing the vacuum cleaner 11.

The operation of the above-described embodiment is described next.

The secondary battery 16 transmits a voltage V and a charging state CS to the control unit 17 through the output part 26. In an example, the secondary battery 16 transmits the value of 1 as a charging state CS in the case where the secondary battery 16 is during charging, and transmits the value of 0 in other cases.

The setting button 20 transmits an operation request DD to the control unit 17. In an example, the setting button 20 transmits the value of 1 as an operation request DD in the case where the vacuum cleaner 11 is to be operated, that is, in the case of turning-on, and transmits the value of 0 in the case where the vacuum cleaner 11 is to be stopped, that is, in the case of turning-off.

The control unit 17 then accepts respectively the voltage V and the charging state CS from the secondary battery 16 and the operation request DD from the setting button 20, and accordingly controls the operation of the electric blower 15 and the operation of the light emitting part 21.

The outline of the operation of the vacuum cleaner 11 is described first.

The vacuum cleaner 11 sets the operation of the electric blower 15 or the vacuum cleaner 11 on the basis of the type of the secondary battery 16, the voltage of the secondary battery 16, the charging status of the secondary battery 16, for example, whether or not the secondary battery 16 is during charging, and the presence or absence of the operation by a user on the setting button 20. The vacuum cleaner 11 applies the negative pressure generated by the operation of the electric blower 15 to a floor surface or the like, thereby sucking dust and dirt together with air to catch and collect the dust and dirt into the dust-collecting unit 14. Then, for example, at the end of cleaning, in the period between the end of cleaning and the next start of cleaning, or at the timing of the next start of cleaning, the vacuum cleaner 11 corrects, when necessary, the suction force of the electric blower 15 for the next cleaning.

Figure 4:
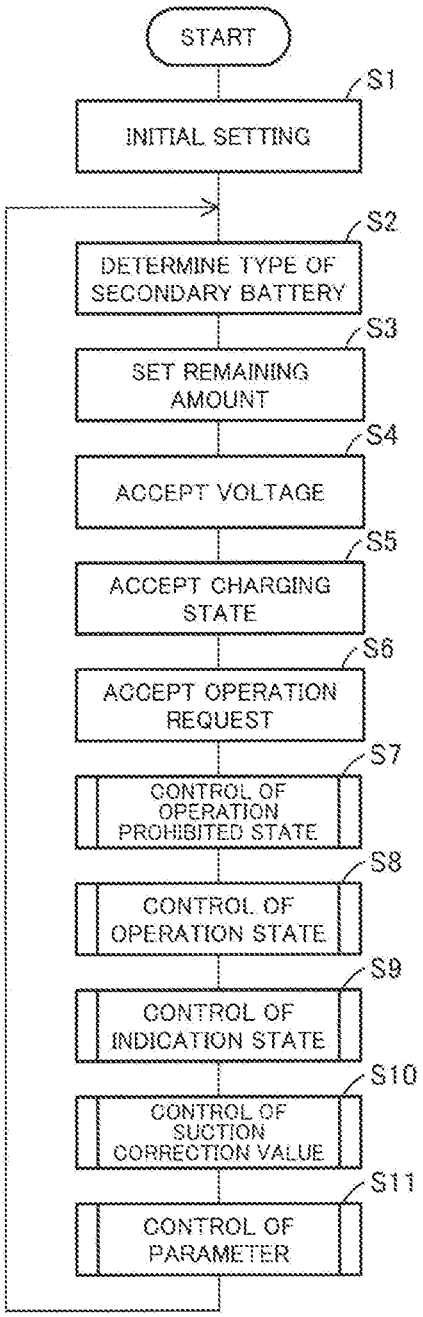
FIG. 4 is a flowchart indicating an outline of an operation of the above vacuum cleaner.

The flowchart shown in. FIG. 4 indicates the outline of the operation of the vacuum cleaner 11.

First in step S1, the vacuum cleaner 11 sets, as initial setting, "operation prohibited state DA=0", "operation State DS=0", "operation request DD=0", "charging state CS=0", "indication mode DP=0", "suction correction value VC=0", and "suction correction flag FC=0". In the present embodiment, the state "operation prohibited state DA=1" corresponds to an operation prohibited state, while the state "operation prohibited state DA=0" corresponds to an operation permitted state. Also, the state "operation state DS=1" corresponds to an operation state, while the state "operation state DS=0" corresponds to a stop of operation state. The state "operation request DD=1" corresponds to an operation requested state, while the state "operation request DD=0" corresponds to an operation not-requested state. The state "charging state CS=1" corresponds to a charging state, while the state "charging state CS=0" corresponds to a not-charging state. The state "indication mode DP=0", "indication mode DP=1", and "indication mode DP=2" respectively correspond to a first indication mode, a second indication mode, and a third indication mode. These values are set as indexes merely indicating different states. Although the values representable by one bit and two bits are used in the present embodiment, values themselves are not limited to the values above.

Then in step S2, the control unit 17 determines the type of the secondary battery 16 under use. In step S3, the control unit 17 sets a predetermined remaining amount or a fifth voltage threshold value Vth5 to be described below according to the type of the secondary battery 16. It is noted that, in step S3, the control unit 17 may further set a predetermined value or a fourth voltage threshold value Vth4 to be described below according to the type of the secondary battery 16. In the case where only one type of the secondary battery 16, not a plurality of types of the secondary batteries 16 having different capacities, is used, neither step S2 nor step S3 is necessary. In step S4 and step S5, the control unit 17 accepts the remaining amount, that is, the voltage V and the charging state CS from the secondary battery 16. In step S6, the control unit 17 accepts the operation request DD from the setting button 20. The steps of step S4 to step S6 may be performed in any order. In step S7, the control unit 17 performs control of the operation prohibited state. In step S8, the control unit 17 performs control of the operation state. In step S9, the control unit 17 performs control of the indication state of the light emitting part 21. In step S10, the control unit 17 performs control of a suction correction value. In step S11, the control unit 17 performs control of a parameter. Thereafter the processing returns to step S2.

The control of the operation prohibited state by the control unit 17 is described next.

The control unit 17 does not permit the electric blower 15 or the vacuum cleaner 11 to operate under the state where the remaining amount or the voltage of the secondary battery is less than a predetermined operation not-permitted remaining amount or a first voltage threshold value. As the first voltage threshold value, for example, a discharge end voltage or a low voltage close to the discharge end voltage is set. Under the state where the remaining amount or the voltage of the secondary battery 16 is larger than a predetermined operation permitted remaining amount or a second voltage threshold value which is larger than the operation not-permitted remaining amount or the first voltage threshold value, the control unit 17 permits the electric blower 15 or the vacuum cleaner 11 to operate.

Figure 5:
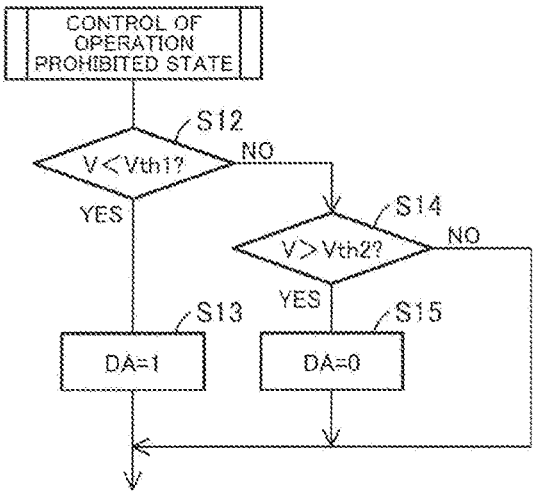
FIG. 5 is a flowchart indicating control of an operation prohibited state of the above vacuum cleaner.

The flowchart shown in FIG. 5 indicates the control of the operation prohibited state by the control unit 17.

In step S12, the control unit 17 first determines whether or not the accepted voltage V of the secondary battery 16 is lower than the first voltage threshold value Vth1. In the case where, in step S12, the control unit 17 determines that the voltage V is lower than the first voltage threshold value Vth1, then in step S13, the control unit 17 sets "operation prohibited state DA=1", that is, the operation prohibited state, and the processing advances to the next step. While in the case where, in step S12, the control unit 17 determines that the voltage V is not lower than the first voltage threshold value Vth1, then in step S14, the control unit 17 determines whether or not the accepted voltage V of the secondary battery 16 is larger than the second voltage threshold value Vth2. In the case where, in step S14, the control unit 17 determines that the voltage V is larger than the second voltage threshold value Vth2, then in step S15, the control unit 17 sets "operation prohibited state DA=0" or the operation permitted state, and the processing then advances to the next step. In the case where, in step S14, the control unit 17 determines that the voltage V is not larger than the second voltage threshold value Vth2, the control unit 17 does not perform any control, and the processing then advances to the next step.

The control of the operation state of the electric blower 15 by the control unit 17 is described next.

The control unit 17 makes the electric blower 15 operate, in the case where, during stop of operation and under the state where the secondary battery 16 is not during charging, the remaining amount or the voltage of the secondary battery 16 is larger than the operation permitted remaining amount or the second voltage threshold value, and where a user operates the setting button 20 to give instruction to start operation. While in the case where a user operates the setting button 20 to give instruction to stop operation during the operation of the electric blower 15, the control unit 17 makes the electric blower 15 stop.

Figure 6:
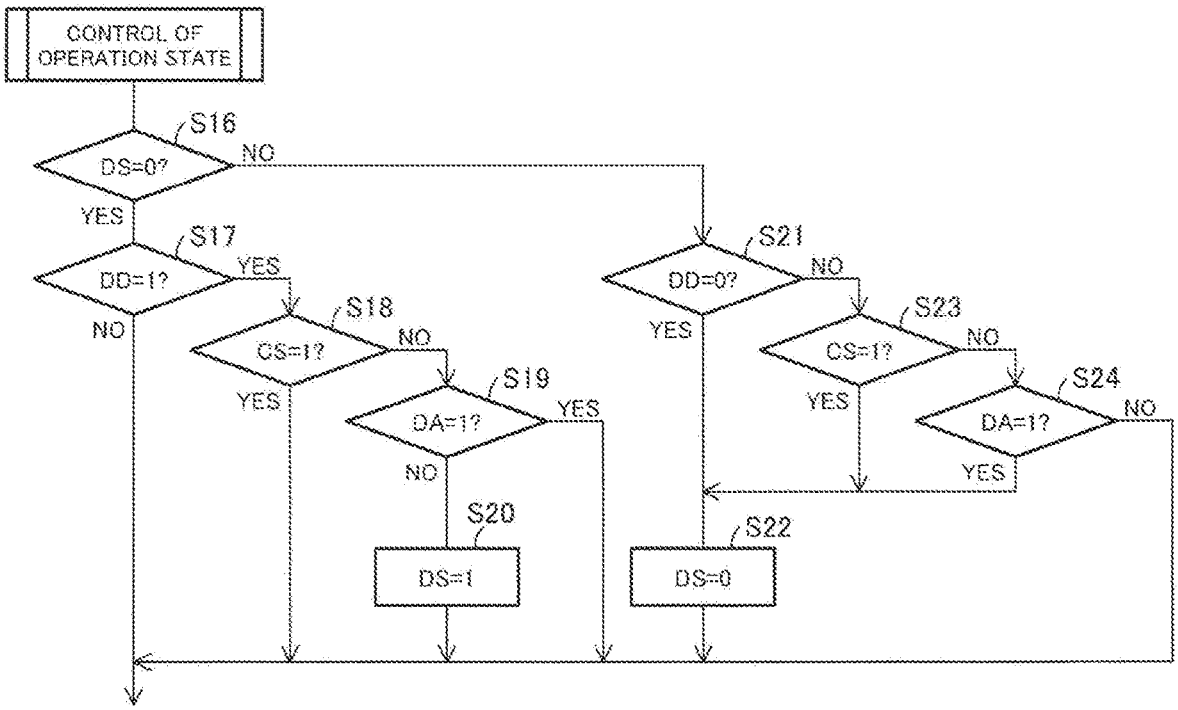
FIG. 6 is a flowchart indicating control of operation states of an electric blower of the above vacuum cleaner.

The flowchart shown in FIG. 6 indicates the control of the operation states of the vacuum cleaner 11 by the control unit 17.

In step S16, the control unit 17 first determines whether or not "operation state DS=0" is set. In the case where, in step S16, the control unit 17 determines that "operation state DS=0" is set, then in step S17, the control unit 17 determines whether or not "operation request. DD=1" is set or whether operation is requested. In the case where, in step S17, the control unit 17 determines that "operation request DD=1" is not set, that is, "operation request DD=0" is set or that operation is not requested, the control unit 17 does not perform any control, and the processing then advances to the next step. While in the case where, in step S17, the control unit 17 determines that "operation request DD=1" is set or that operation is requested, then in step S18, the control unit 17 determines whether or not "charging state CS=1" is set or whether being during charging. In the case where, in step S18, the control unit 17 determines that "charging state CS=1" is set or being during charging, the control unit 17 does not perform any control, and the processing then advances to the next step. While in the case where, in step S18, the control unit 17 determines that "charging state CS=1" is not set, that is, "charging state CS=0" is set, or being not during charging, then in step S19, the control unit 17 determines whether or not "operation prohibited state DA=1" is set or whether operation is prohibited. In the case where, in step S19, the control unit 17 determines that "operation prohibited state DA=1" is set or that operation is prohibited, then the control unit 17 does not perform any control, and the processing then advances to the next step. While in the case where, in step S19, the control unit 17 determines that "operation prohibited state DA=1" is not set, that is, "operation prohibited state DA=0" is set or that operation is permitted, then in step S20, the control unit 17 sets "operation state DS=1", and the processing then advances to the next step.

In the case where, in step S16, the control unit 17 determines that. "operation state DS=0" is not set, that is, "operation state DS=1" is set, then in step S21, the control unit 17 determines whether or not "operation request DD=0" is set or whether operation is not, requested. In the case where, in step S21, the control unit 17 determines that "operation request DD=0" is set or that operation is not requested, then in step S22, the control unit 17 sets "operation state DS=0", and the processing then advances to the next step. While in the case where, in step S21, the control unit 17 determines that "operation request DD=0" is not set, that is, "operation request DD=1" is set or that operation is requested, then in step S23, the control unit 17 determines whether or not "charging state CS=1" is set or whether being during charging. In the state where, in step S23, the control unit 17 determines that "charging state CS=1" is set or being during charging, the processing then advances to step S22. While in the case where, in step S23, the control unit 17 determines that "charging state CS=1" is not set, that is, "charging state CS=0" is set or being not during charging, then in step S24, the control unit 17 determines whether or not "operation prohibited state DA=1" is set. In the case where, in step S24, the control unit 17 determines that "operation prohibited state DA=1" is set or that operation is prohibited, the processing by the control unit. 17 then advances to step S22. While in the case where, in step S24, the control unit 17 determines that "operation prohibited state DA=0" is set or that operation is permitted, the control unit 17 does not perform any control, and the processing then advances to the next step.

The control of the indication state of the light emitting part 21 by the control unit 17 is described next.

In the case where the remaining amount or the voltage of the secondary battery 16 is equal to or more than the operation permitted remaining amount or a third voltage threshold value under the state where the secondary battery 16 is not during charging, the control unit 17 sets a first indication mode for the light emitting part 21. In the case where the remaining amount or the voltage of the secondary battery 16 is less than the operation permitted remaining amount or the third voltage threshold value under the state where the electric blower 15 is during operation, the control unit 17 sets a second indication mode different from the first indication mode for the light emitting part 21. The control unit 17 sets a third indication mode for the light emitting part 21 under the state where the electric blower 15 is during charging. In an example, the first indication mode corresponds to a lighting-on state, the second indication mode corresponds to a flickering state, and the third indication mode corresponds to a flickering state of flickering in a longer cycle than the cycle in the second indication mode. Although the third indication mode is preferably different from the first indication mode and the second indication mode, the third indication mode may be the same indication mode as, for example, the second indication mode. The indication modes in the present embodiment indicate the light emitting states of the light emitting part 21, and thus the light emitting part 21 is not limited to be in the lighting-on state. Examples of the indication modes of the light emitting part 21 may include the state of the light emitting part 21 prevented from lightning-on and the lighting-off state.

Figure 7:
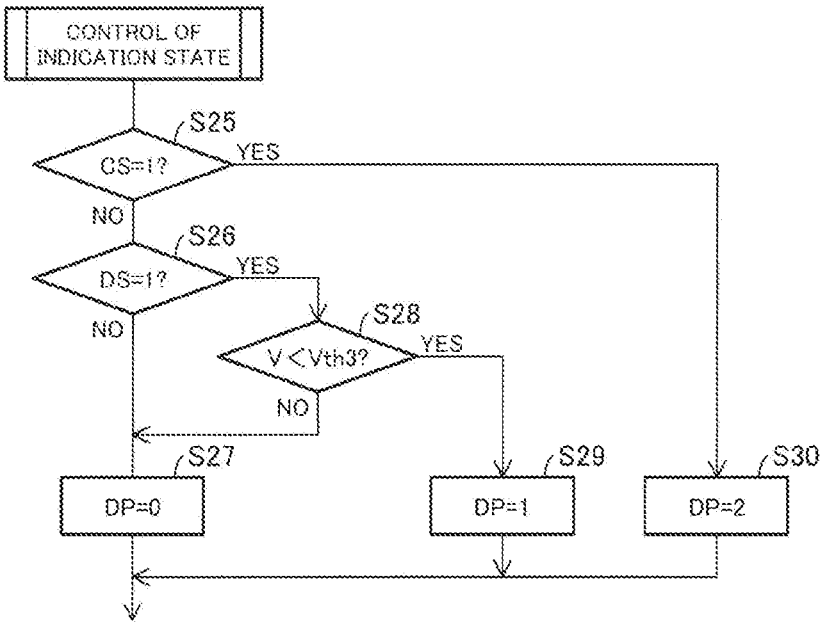
FIG. 7 is a flowchart indicating control of indication modes of a light emitting part of the above vacuum cleaner.

The flowchart shown in FIG. 7 indicates the control of the indication modes of the light emitting part 21 by the control unit 17.

First in step S25, the control unit 17 determines whether or not "charging state CS=1" is set or whether being during charging. In the case where, in step S25, the control unit 17 determines that "charging state CS=1" is not set, that is, "charging state CS=0" is set, or being not during charging, then in step S26, the control unit 17 determines whether or not "operation state DS=1" is set or whether being during operation. In the case where, in step S26, the control unit 17 determines that "operation state DS=1" is not set, that is, "operation state DS=0" is set or being during stop, then in step S27, the control unit 17 sets "indication mode DP=0", that is, the first indication mode for the light emitting part 21, and the processing then advances to the next step. While in the case where, in step S26, the control unit 17 determines that "operation state DS=1" is set or that being during operation, then in step S28, the control unit 17 determines whether or not the voltage V of the secondary battery 16 is lower than the third voltage threshold value Vth3. In the case where, in step S28, the control unit 17 determines that the voltage V is lower than the third voltage threshold value Vth3, then in step S29, the control unit 17 sets "indication mode DP=1", that is, the second indication mode for the light emitting part 21, and the processing then advances to the next step. While in the case where, in step S28, the control unit 17 determines that the voltage V is not lower than the third voltage threshold value Vth3, the processing by the control unit 17 then advances to step S27. In the case where, in step S25, the control unit 17 determines that "charging state CS=1" is set or being during charging, then in step S30, the control unit 17 sets "display mode DP=2", that is, the third indication mode for the light emitting part 21, and the processing then advances to the next step.

It is noted that arbitrary control other than the control described above of the indication modes of the light emitting part 21 is available, and in the case of the vacuum cleaner 11 configured without the light emitting part 21, the control itself of the indication modes is unnecessary.

The control of the suction correction of the electric blower 15 by the control unit 17 is described next.

The control unit 17 keeps the remaining amount or the voltage of the secondary battery 16 at the end of the cleaning, corrects, when necessary, the suction force of the electric blower 15 for the next operation on the basis of the remaining amount or the voltage, thereby changing the level of the consumption in the secondary battery 16 by the driving of the electric blower 15 in the next operation, resulting in automatically adjusting the cleaning available time and the suction force thereof. The timing of correcting the suction force is able to be set to arbitrary timing from the end of the cleaning to the next startup of the electric blower 15, such as the end of the cleaning, timing in the period from the end of the cleaning to the next start of the cleaning, or just after the next start of the operation. The timing of the end of the cleaning herein is preferably the timing after the end of a series of cleaning operation, for example, the timing when the operation of the electric blower 15 is stopped and the charging of the secondary battery 16 is started, or the timing when the vacuum cleaner 11 is stored, that is, the timing when the vacuum cleaner main body 13 is attached to the storage stand 12. The increase/reduction in the suction force of the electric blower 15 is set on the basis of the remaining amount, that is, the voltage, of the secondary battery 16 at the end of the cleaning of the electric blower 15. Specifically, in the case where the cleaning is finished under the state where the remaining amount or the voltage of the secondary battery 16 is equal to or less than the predetermined value or the fourth voltage threshold value, the control unit 17 sets the parameter P so as to reduce the suction force of the electric blower 15 for the next operation. In the case where the cleaning is finished under the state where the remaining amount or the voltage of the secondary battery 16 is larger than the predetermined value or the fourth voltage threshold value, the control unit 17 sets the parameter P so as to increase the suction force of the electric blower 15 for the next operation. As described above, the predetermined amount or the fourth voltage threshold value serving as the threshold value for determining increase/reduction of the suction force of the electric blower 15 for the next operation is used for determining whether or not the remaining amount of the secondary battery 16 is small, and accordingly, for example, a discharge end voltage or a voltage close to the discharge end voltage is preferable.

The control unit 17 may set the parameter P for increasing/reducing the suction force of the electric blower 15, on condition that the secondary battery 16 is charged to the level where the remaining amount or the voltage of the secondary battery 16 is larger than the predetermined remaining amount or the fifth voltage threshold value larger than the above predetermined value or the fourth voltage threshold value. That is, the control unit 17 may correct the suction force of the electric blower 15 for the next operation, only in the case where the secondary battery 16 is charged sufficiently to the level where the remaining amount or the voltage of the secondary battery 16 is more than the predetermined remaining amount or the fifth voltage threshold value, and may not correct the suction force of the electric blower 15 for the next operation in the case where the secondary battery 16 is not charged sufficiently. The control unit 17 preferably sets the parameter P which does not exceed a predetermined upper limit value or the parameter P which does not exceed a predetermined lower limit value set larger than 0. The control unit 17 more preferably sets the parameter P which is neither larger than a predetermined upper limit value nor smaller than a predetermined lower limit value.

Figure 8:
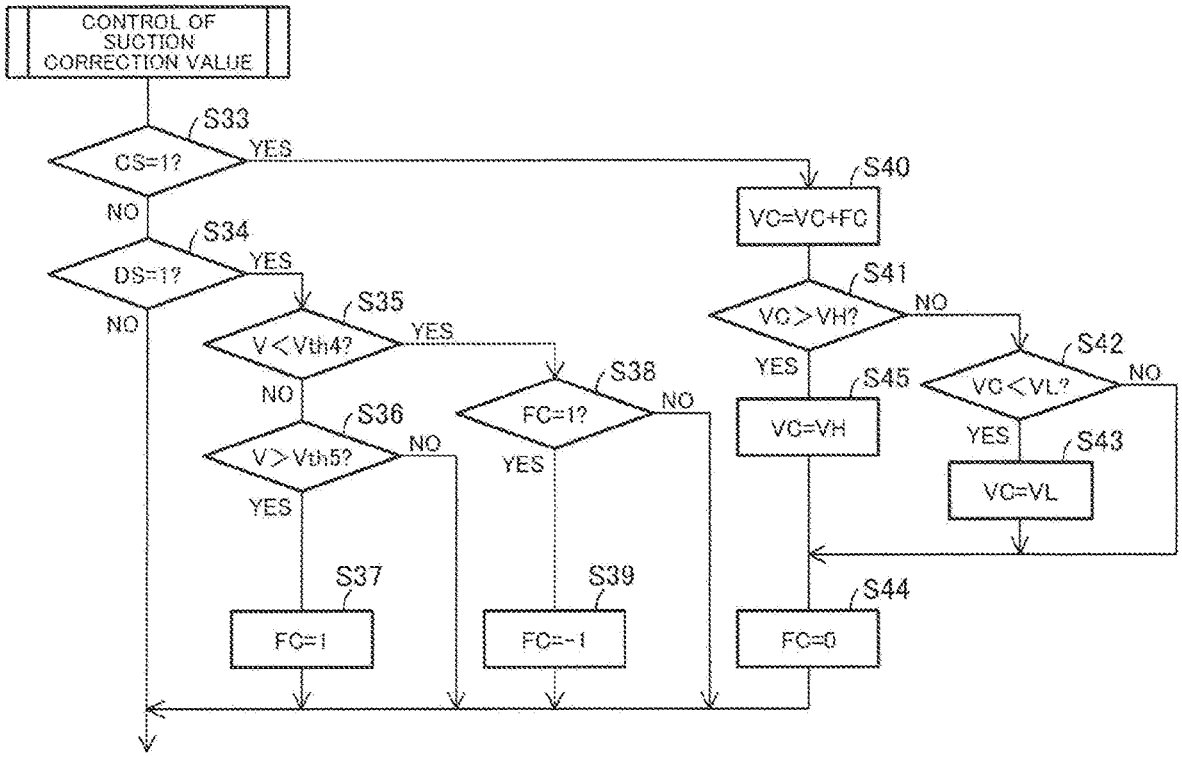
FIG. 8 is a flowchart indicating control of suction correction values of the electric blower of the above vacuum cleaner.

The flowchart shown in FIG. 8 indicates the control of the suction correction value VC by the control unit 17.

In step S33, the control unit 17 first determines whether or not "charging state CS=1" is set or whether being during charging. In the case where, in step S33, the control unit 17 determines that "charging state CS=1" is not set, that is, "charging state CS=0" is set, or being not during charging, then in step S34, the control unit 17 determines whether or not "operation state DS=1" is set or whether being during operation. In the case where, in step S34, the control unit 17 determines that "operation state DS=1" is not set, that is, "operation state DS=0" is set, or being during stop, the control unit 17 does not perform any control, and the processing thus advances to the next, step. While in the case where, in step S34, the control unit 17 determines that "operation state DS=1" is set, or being during operation, then in step S35, the control unit 17 determines whether or not the voltage V of the secondary battery 16 is lower than the fourth voltage threshold value Vth4. In the case where, in step S35, the control unit 17 determines that the voltage V of the secondary battery 16 is not lower than the fourth voltage threshold value Vth4, then in step S36, the control unit 17 determines whether or not the voltage V of the secondary battery 16 is larger than the fifth voltage threshold value Vth5. In the case where, in step S36, the control unit 17 determines that the voltage V of the secondary battery 16 is not larger than the fifth voltage threshold value Vth5, then the control unit 17 does not perform any control, and the processing then advances to the next step. While in the case where, in step S36, the control unit 17 determines that the voltage V of the secondary battery 16 is larger than the fifth voltage threshold value Vth5, then in step S37, the control unit 17 sets "suction correction flag FC=1", and the processing then advances to the next step. In the case where, in step S35, the control unit 17 determines that the voltage V of the secondary battery 16 is lower than the fourth voltage threshold value Vth4, then in step S38, the control unit 17 determines whether or not. "suction correction flag FC=1" is set. In the case where, in step S38, the control unit 17 determines that "suction correction on flag FC=1" is set, then in step S39, the control unit 17 sets "suction correction flag FC=−1", and the processing then advances to the next step. While in the case where, in step S38, the control unit 17 determines that "suction correction flag FC=1" is not set, the control unit 17 does not perform any control, and the processing then advances to the next step. It is noted that in the case where the parameter P for increasing/reducing the suction force of the electric blower 15 is set regardless of the condition that the secondary battery 16 is charged to the level where the remaining amount or the voltage of the secondary battery 16 is larger than the predetermined remaining amount or the fifth voltage threshold value, the processing in step S35 to step S39 is able to be more simplified. In this case, in the case where, in step S34, the control unit 17 determines that "operation state DS=1" is set or being during operation, the control unit 17 sets "suction correction flag FC=1". Thereafter, in the case where the voltage V of the secondary battery 16 is lower than the fourth voltage threshold value Vth4, the processing advances to the next step, while in the case where the voltage V of the secondary battery 16 is not lower than the fourth voltage threshold value Vth4, the control unit 17 sets "suction correction flag FC=−1", and the processing advances to the next step.

Further in the case where, in step S33, the control unit 17 determines that "charging state CS=1" is set, then in step S40, the control unit 17 sets a value obtained by adding the value of the suction correction flag FC to the suction correction value VC, as a new suction correction value VC. Next in step S41, the control unit 17 determines whether or not the new suction correction value VC is larger than a predetermined highest correction value VH. In the case where, in step S41, the control unit 17 determines that the new suction correction value VC is not larger than the predetermined highest correction value VH, then in step S42, the control unit 17 determines whether or not the new suction correction value VC is smaller than a predetermined lowest correction value Vt. In the case where, in step S42, the control unit 17 determines that the new suction correction value VC is smaller than the predetermined lowest correction value VL, then in step S43, the control unit 17 sets the new suction correction value VP as the lowest correction value VL. Then in step S44, the control unit 17 sets "suction correction flag FC=0", and the processing then advances to the next step. While in the case where, in step S42, the control unit 17 determines that the new suction correction value VC is not smaller than the predetermined lowest correction value VL, the processing by the control unit 17 then advances straight to step S44. In the case where, in step S41, the control unit 17 determines that the new suction correction value VC is larger than the predetermined highest correction value VH, then in step S45, the control unit 17 sets the new suction correction value VC as the highest correction value VH, and the processing then advances to step S44. That is, in the case where "suction correction flag FC=1" is set, the suction correction value VC is increased within an upper range to the predetermined highest correction value VH. In the case where "suction correction flag FC=−1" is set, the suction correction value VC is reduced within a lower range to the predetermined lowest correction value VL. It is noted that in the case where the upper limit value and the lower limit value of the parameter P are not set, none of the processing for control from step S41 to step S43 or the processing for control in step S45 is necessary.

Figure 9:
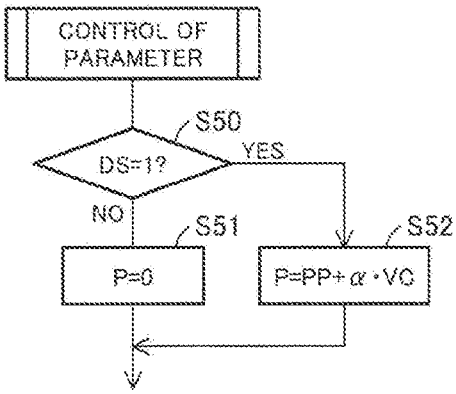
FIG. 9 is a flowchart indicating control of parameters for setting suction force of the electric blower of the above vacuum cleaner.

The flowchart shown in FIG. 9 indicates the control of the parameter P for setting the suction force of the electric blower 15 by the control unit 17.

In step S50, the control unit 17 first determines whether or not "operation state DS=1" is set. In the case where, in step S50, the control unit 17 determines that "operation state DS=1" is not set, that is, "operation state DS=0" is set, then in step S51, the control unit 17 sets "parameter P=0", that is, the state not allowing the electric blower 15 to be driven, and the processing for control then advances to the next step. While in the case where, in step S50, the control unit 17 determines that "operation state DS=1" is set, then in step S52, the control unit 17 sets a value obtained by adding a positive initial value PP and a value obtained by multiplying a predetermined positive constant $\alpha$ by the suction correction value VC, as a new parameter P, and the processing for control then advances to the next step in this case, the highest correction value VH and the lowest correction value VL are set for the suction correction value VC, whereby the parameter P is prevented from becoming larger than the predetermined upper limit value and becoming lower than the predetermined lower limit value.

Specific description is given by referring to FIGS. 10A1, 10A2, 10A3, 10B1, 10B2 and 10B3, of the state where the suction force of the vacuum cleaner 11 and the cleaning time in the present embodiment are automatically adjusted for each user.

FIGS. 10A1, 10A2 and 10A3 indicate the states where one user uses the vacuum cleaner 11. FIGS. 10B1, 10B2 and 10B3 indicate the states where another user uses the vacuum cleaner 11. In an example, the one user needs longer cleaning time than another user. In FIGS. 10A1, 10A2, 10A3, 10B1, 10B2 and 10B3, the horizontal axis indicates cleaning time, while the vertical axis indicates current output by the secondary battery 16. In each drawing, an area of a rectangle indicates a charge amount in single-time cleaning. It is noted that the secondary battery 16 at the start of cleaning is in a fully charged state.

Figure 10:
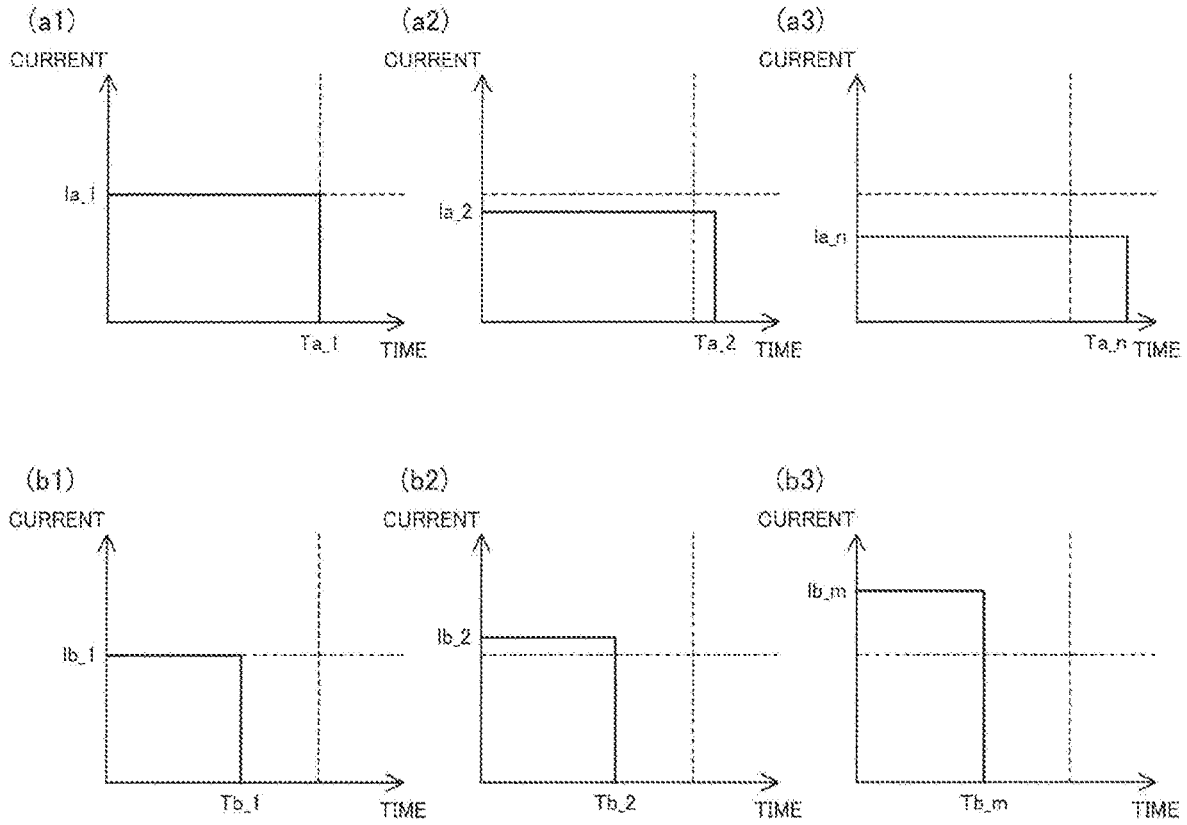

FIG. 10A1 indicates the first cleaning performed by the one user. The value Ia_1 indicates the current during cleaning corresponding to the case where the parameter P of the electric blower 15 is set to the initial value PP. The value Ta_1 of this case indicates cleaning time. The remaining amount or the voltage V of the secondary battery 16 at the end of the cleaning is less than the predetermined value or the fourth voltage threshold value Vth4, which corresponds to the state where the secondary battery 16 has run out in the middle of the cleaning, or the secondary battery 16 will run out in a short time in the cleaning. In this case, "suction correction flag FC=−1" is set through the control shown in FIG. 8, and "suction correction value VC=−1" is set at the end of the cleaning, for example, at the start of the charging of the secondary battery 16.

In the case where the one user performs the second cleaning (FIG. 10A2), the parameter P is set to the value of "initial value PP—constant α" through the control shown in FIG. 9, and thus the value of the current Ia_2 in the second cleaning is smaller than the value of the current Ia_1 in the first cleaning (that is, Ia_2<Ia_1). That is, since the current of the secondary battery 16 has been reduced, the suction force of the electric blower 15 is reduced as compared to the case of the first cleaning, and the cleaning time Ta_2 in the second cleaning is prolonged as compared to the cleaning time Ta_1 in the first time (that is, Ta_2>Ta_1). Since the remaining amount or the voltage V of the secondary battery 16 at the end of the cleaning is less than the predetermined value or the fourth voltage threshold value Vth4, the current of the secondary battery 16 in the third cleaning is further reduced through the control shown in FIG. 9, and the cleaning time is further prolonged. As such adjustment is repeated likewise, the remaining amount or the voltage V of the secondary battery 16 at the end of the cleaning gradually approaches the predetermined value or the fourth voltage threshold value Vth4. The remaining amount or the voltage V of the secondary battery 16 in the n-th cleaning shown in FIG. 10A3 becomes close to the predetermined value or the fourth voltage threshold value Vth4. This corresponds to the state where the cleaning time reaches the cleaning time necessary for the one user and where the charge stored in the secondary battery 16 has been almost used up to the end.

FIG. 10B1 indicates the first cleaning performed by another user. The current Ib_1 during the cleaning corresponds to the case where the parameter P of the electric blower 15 is set to the initial value PP, and is identical to the value of the current Ia_1. The value Tb_1 indicates cleaning time, and the cleaning time Tb_1 is shorter than the cleaning time Ta_1 in the first cleaning performed by the one user (that is, Tb_1<Tal). The remaining amount or the voltage V of the secondary battery 16 at the end of the cleaning is larger than the predetermined value or the fourth voltage threshold value Vth4, which corresponds to the state where the charge stored in the secondary battery 16 has not been used up at the end of the cleaning. In this case, "suction correction flag FC=1" is set through the control shown in FIG. 8, and "suction correction value VC=1" is thus set at the end of the cleaning, for example, at the start of the charging of the secondary battery 16.

As shown in FIG. 10B2, when the another user starts the second cleaning, the parameter P is set to the value of "initial value PP+constant α" through the control shown in FIG. 9, and thus the value of the current Ib_2 in the second cleaning is larger than the value of the current Ib_1 in the first cleaning (that is, Ib_2>Ib_1). That is, since the current of the secondary battery 16 has been increased, the suction force of the electric blower 15 is increased as compared to the case of the first cleaning. Since the charge stored in the secondary battery 16 has not been used up in the first cleaning, the cleaning time Tb_2 in the second cleaning is estimated to be a substantially equal length of the cleaning time Tb_1 in the first cleaning. Since the remaining amount or the voltage V of the secondary battery 16 is larger than the predetermined value or the fourth voltage threshold value Vth4, the current in the third cleaning further is increased through the control shown in FIG. 9. As such adjustment is repeated likewise, the remaining amount or the voltage V of the secondary battery 16 at the end of the cleaning gradually approaches the predetermined value or the fourth voltage threshold value Vth4. The remaining amount or the voltage V of the secondary battery 16 in the m-th cleaning shown in FIG. 10B3 becomes close to the predetermined value or the fourth voltage threshold value Vth4. This corresponds to the state where the cleaning time reaches the cleaning time necessary for another user and where the charge stored in the secondary battery 16 has been almost used up to the end.

Accordingly, as the cleaning is repeated, the suction force of the electric blower 15 is automatically adjusted so that the cleaning time is lengthened in the case of a user needing relatively longer cleaning time, and the suction force of the electric blower 15 is automatically adjusted so that the suction force of the electric blower 15 is maximized within the cleaning time in the case of another user needing relatively short cleaning time. That is, as the cleaning is repeated, the length of the cleaning available time and the suction force of the electric blower 15 are optimized automatically and gradually according to user's need. The parameter P of the electric blower 15 is automatically adjusted so that the suction force thereof is maximized on condition that the cleaning time necessary for each user in cleaning is ensured.

Figure 11:
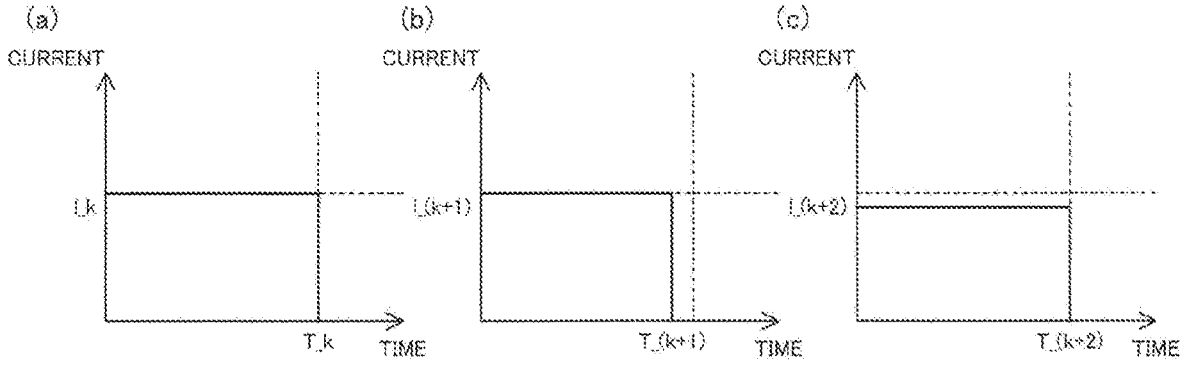
FIGS. 11A, 11B and 11C

Even in the case where a storable charge amount is decreased due to degradation or repetitive charging and discharging of the secondary battery 16, the control described above is performed, whereby the length of the cleaning available time and the suction force of the electric blower 15 are adjusted automatically according to the level of the degradation. In an example, in FIG. 11A indicating the k-th cleaning performed by a user, the parameter P is automatically adjusted at this time point, and the value I_k indicates current of the electric blower 15, and the value T_k indicates cleaning time. That is, in the k-th cleaning, after the cleaning time T_k elapses, the remaining amount or the voltage V of the secondary battery 16 is close to the predetermined value or the fourth voltage threshold value Vth4, which corresponds to the state where the charge stored in the secondary battery 16 has been almost used up to the end. If the remaining amount or the voltage V of the secondary battery 16 at the end of the (k+1)-th cleaning shown in FIG. 11B is decreased less than the predetermined value or the fourth voltage threshold value Vth4 due to the degradation of the secondary battery 16, "suction correction flag FC=−1" is set through the control shown in FIG. 8, and the value of 1 is subtracted from the suction correction value VC at the end of the cleaning, for example, at the start of the charging. Accordingly, in the (k+2)-th cleaning shown in FIG. 11C, the current I_(k+2) during cleaning is reduced lower than the current I_(k+1) (that is, I_(k+2)<I_(k+1)), and the cleaning time T_(k+2) is increased longer than the cleaning time T_(k+1) in the (k+1)-th cleaning so as to be adjusted to the cleaning time T_k in the k-th cleaning (that is, T_(k+2)=T_k). As described above, the parameter P of the electric blower 15 is automatically adjusted so as to ensure necessary cleaning time in response to the degradation of the secondary battery 16.

As described so far, in the present embodiment, in the case where the cleaning is finished under the state where the remaining amount of the secondary battery 16 is equal to or less than a predetermined value, the control unit 17 determines that the actually available cleaning time is insufficient for the cleaning time necessary for a user in cleaning, and thus sets the parameter P for reducing the suction force of the electric blower 15 for the next cleaning. While in the case where the cleaning is finished under the state where the remaining amount of the secondary battery 16 is not equal to or less than a predetermined value, the control unit 17 determines that a user finishes the cleaning in relatively short cleaning time, and that the capacity of the secondary battery 16 at the time has not been used up, and then sets the parameter P for increasing the suction force of the electric blower 15 for the next cleaning. Accordingly, the vacuum cleaner 11 is controlled, in the case of a user needing longer cleaning time, so as to lengthen the cleaning available time while ensuring the suction force of the electric blower 15 equal to or more than a predetermined level, while in the case of a user needing shorter cleaning time, so as to increase the suction force of the electric blower 15 while ensuring the cleaning available time equal to or more than a predetermined level. As a result, the cleaning available time and the suction force are able to be automatically optimized so that the capacity of the secondary battery 16 is used up as much as possible.

That is, in the case where the same user uses the vacuum cleaner 11 to clean the same cleaning area, it is estimated that, in general, the user performs the cleaning substantially in the same cleaning time, and thus an approximate length of the cleaning time necessary for the user in usual cleaning is able to be estimated on the basis of the remaining amount of the secondary battery 16 at the time of cleaning after the cleaning by the user. Therefore, the parameter P is set on the basis of the estimation, thereby enabling to adjust the parameter P for maximizing the suction force of the electric blower 15 so that the cleaning time necessary for the user is ensured and that the limited capacity of the secondary battery 16 is used up. Setting of a small adjustment range for each time of the parameter P prevents the cleaning available time and the suction force from changing largely even in the case where the user sporadically performs cleaning different from the usual cleaning, and thus the next cleaning to be performed in the usual manner is suppressed from being affected. That is, the cleaning available time and the suction force are automatically and reliably-precisely adjusted so that the capacity of the secondary battery 16 is used up.

In the case where a user uses the vacuum cleaner 11 including the secondary battery 16 with no charge or a slightly remaining amount to perform cleaning after briefly charging the vacuum cleaner 11, the user himself/herself recognizes that the secondary battery 16 is not sufficiently charged, and thus may perform the cleaning highly possibly in a short time. Therefore, on condition that the secondary battery 16 has been charged up to a level larger than the predetermined remaining amount which is larger than a predetermined value, the control unit 17 sets the parameter P for increasing/reducing the suction force of the electric blower 15. In other words, the control unit 17 does not correct the parameter P of the electric blower 15 unless the cleaning is started under the state where the secondary battery 16 has been charged up to the level of the remaining amount or the voltage of the secondary battery 16 larger than the predetermined remaining amount or the fifth voltage threshold value, thereby enabling to more precisely and automatically adjusting the cleaning available time and the suction force.

If the parameter P of the electric blower 15 is excessively large, the current of the electric blower 15 becomes excessively large and may cause high temperature. While if the parameter P is excessively small, the current of the electric blower 15 becomes excessively small, and thereby the electric blower 15 may not operate or may operate unstably. Accordingly, the parameter P is set to a value not higher than the upper limit value or a value not lower than the lower limit value, whereby the electric blower 15 is avoided from becoming high in temperature, not operating, or operating unstably, and the electric blower 15 is able to be operated stably.

The remaining amount or the fifth voltage threshold value is set for each of a plurality of types of the secondary batteries 16 having different capacities, whereby the parameter P is able to be adjusted automatically and precisely, in any one of the secondary batteries 16 having different capacities being attached. With the parameters P corresponding to the respective types of the secondary batteries 16 stored in, for example, a memory, even in the case where the cleaning is performed by use of any one of the plurality of secondary batteries 16 depending on the occasion, the cleaning available time and the suction force are able to be automatically adjusted according to the types of the secondary batteries 16.

It is noted that, in the embodiment described above, the parameter P may be set so as only to reduce the suction force of the electric blower 15 for the next cleaning in the case where the cleaning is finished under the state where the remaining amount or the voltage of the secondary battery 16 detected by the detection part 25 is equal to or less than the predetermined value or the fourth voltage threshold value, or alternatively the parameter P may be set so as only to increase the suction force of the electric blower 15 for the next cleaning in the case where the cleanings finished under the state where the remaining amount or the voltage of the secondary battery 16 detected by the detection part 25 is not equal to or less than the predetermined value or the fourth voltage threshold value.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

(1) A control method for a vacuum cleaner configured to perform cleaning by sucking dust and dirt by an electric blower driven by power supplied by a secondary battery includes the steps of reducing a suction force of the electric blower for next cleaning, when cleaning is finished under a state where a remaining amount of the secondary battery is equal to or less than a predetermined value, and increasing the suction force of the electric blower for next cleaning, when cleaning is finished under a state where the remaining amount of the secondary battery is not equal to or less than the predetermined value.

(2) A control method for a vacuum cleaner configured to perform cleaning by sucking dust and dirt by an electric blower driven by power supplied by a secondary battery includes the step of reducing a suction force of the electric blower for next cleaning, when cleaning is finished under a state where a remaining amount of the secondary battery is equal to or less than a predetermined value.

(3) A control method for a vacuum cleaner configured to perform cleaning by sucking dust and dirt by an electric blower driven by power supplied by a secondary battery includes the step of increasing a suction force of the electric blower for next cleaning, when cleaning is finished under a state where a remaining amount of the secondary battery is not equal to or less than a predetermined value.

(4) In the control method for the vacuum cleaner according to any one of (1) to (3), the suction force of the electric blower is set on condition that the secondary battery is charged to a level of the remaining amount of the secondary battery larger than a predetermined remaining amount larger than the predetermined value.

(5) In the control method for the vacuum cleaner according to (4), the various remaining amounts are set corresponding to capacities of the secondary batteries.

(6) in the control method for the vacuum cleaner according to any one of (1) to (5), the suction force of the electric blower is set so as not to exceed an upper limit value, or so as not to exceed a lower limit value.

The invention claimed is:

1. A vacuum cleaner, comprising:

an electric blower driven by power supplied by a secondary battery;

a dust collector that includes the electric blower configured to catch and collect dust and dirt sucked by driving of the electric blower;

remaining amount detector circuitry configured to detect a remaining amount of the secondary battery; and controller circuitry configured to control a suction force of the electric blower by use of a parameter, wherein when a cleaning is finished under a state where the remaining amount of the secondary battery detected by the remaining amount detector circuitry is equal to or less than a predetermined value, the controller circuitry sets the parameter so as to reduce the suction force of the electric blower for a next cleaning regardless of the remaining amount of the secondary battery at a start of the cleaning, and when the cleaning is finished under a state where the remaining amount of the secondary battery detected by the remaining amount detector circuitry is more than the predetermined value, the controller circuitry sets the parameter so as to increase the suction force of the electric blower for the next cleaning regardless of the remaining amount of the secondary battery at the start of the cleaning.

2. The vacuum cleaner according to claim 1, wherein the controller circuitry sets the parameter of the suction force of the electric blower on condition that the secondary battery is charged up to a level of the remaining amount detected by the remaining amount detector circuitry that is larger than a predetermined remaining amount, the predetermined remaining amount being larger than the predetermined value.

3. The vacuum cleaner according to claim 2, wherein in the controller circuitry, various remaining amounts are set corresponding to capacities of the secondary battery.

4. The vacuum cleaner according to claim 1, wherein the controller circuitry sets the parameter not higher than an upper limit value, or the parameter not lower than a lower limit value.

5. The vacuum cleaner according to claim 2, wherein the controller circuitry sets the parameter not higher than an upper limit value, or the parameter not lower than a lower limit value.

6. The vacuum cleaner according to claim 3, wherein the controller circuitry sets the parameter not higher than an upper limit value, or the parameter not lower than a lower limit value.

7. A vacuum cleaner, comprising:

an electric blower driven by power supplied by a secondary battery;

a dust collector that includes the electric blower configured to catch and collect dust and dirt sucked by driving of the electric blower;

remaining amount detector circuitry configured to detect a remaining amount of the secondary battery; and controller circuitry configured to control a suction force of the electric blower by use of a parameter, wherein when a cleaning is finished under a state where the remaining amount of the secondary battery detected by the remaining amount detector circuitry is equal to or less than a predetermined value, the controller circuitry sets the parameter so as to reduce the suction force of the electric blower for a next cleaning regardless of the remaining amount of the secondary battery at a start of the cleaning.

8. The vacuum cleaner according to claim 7, wherein the controller circuitry sets the parameter of the suction force of the electric blower on condition that the secondary battery is charged up to a level of the remaining amount detected by the remaining amount detector circuitry that is larger than a predetermined remaining amount, the predetermined remaining amount being larger than the predetermined value.

9. The vacuum cleaner according to claim 8, wherein in the controller circuitry, various remaining amounts are set corresponding to capacities of the secondary batteries.

10. The vacuum cleaner according to claim 7, wherein the controller circuitry sets the parameter not higher than an upper limit value, or the parameter not lower than a lower limit value.

11. The vacuum cleaner according to claim 8, wherein the controller circuitry sets the parameter not higher than an upper limit value, or the parameter not lower than a lower limit value.

12. The vacuum cleaner according to claim 9, wherein the controller circuitry sets the parameter not higher than an upper limit value, or the parameter not lower than a lower limit value.

13. A vacuum cleaner, comprising:

an electric blower driven by power supplied by a secondary battery;

a dust collector that includes the electric blower configured to catch and collect dust and dirt sucked by driving of the electric blower;

remaining amount detector circuitry configured to detect a remaining amount of the secondary battery; and controller circuitry configured to control a suction force of the electric blower by use of a parameter, wherein when a cleaning is finished under a state where the remaining amount of the secondary battery detected by the remaining amount detector circuitry is more than a predetermined value, the controller circuitry sets the parameter so as to increase the suction force of the electric blower fora next cleaning regardless of the remaining amount of the secondary battery at a start of the cleaning.

14. The vacuum cleaner according to claim 13, wherein the controller circuitry sets the parameter of the suction force of the electric blower on condition that the secondary battery is charged up to a level of the remaining amount detected by the remaining amount detector circuitry that is larger than a predetermined remaining amount, the predetermined remaining amount being larger than the predetermined value.

15. The vacuum cleaner according to claim 14, wherein in the controller circuitry, various remaining amounts are set corresponding to capacities of the secondary battery.

16. The vacuum cleaner according to claim 13, wherein the controller circuitry sets the parameter not higher than an upper limit value, or the parameter not lower than a lower limit value.

17. The vacuum cleaner according to claim 14, wherein the controller circuitry sets the parameter not higher than an upper limit value, or the parameter not lower than a lower limit value.

18. The vacuum cleaner according to claim 15, wherein the controller circuitry sets the parameter not higher than an upper limit value, or the parameter not lower than a lower limit value.

* * * * *